US007419196B2

(12) United States Patent
Haugaard et al.

(10) Patent No.: US 7,419,196 B2
(45) Date of Patent: Sep. 2, 2008

(54) DETACHABLE HINGING MECHANISM FOR ACCESS PANEL

(75) Inventors: Eric J. Haugaard, Kenosha, WI (US); Kurt S. Wilcox, Libertyville, IL (US)

(73) Assignee: Ruud Lighting, Inc., Racine, WI (US)

( * ) Notice: Subject to any disclaimer, the term of this patent is extended or adjusted under 35 U.S.C. 154(b) by 160 days.

(21) Appl. No.: 11/089,928

(22) Filed: Mar. 25, 2005

(65) Prior Publication Data

US 2006/0214432 A1 Sep. 28, 2006

(51) Int. Cl.
*E05C 19/10* (2006.01)

(52) U.S. Cl. ..... 292/122; 292/DIG. 11

(58) Field of Classification Search ..... 292/113, 292/247, DIG. 17, 341.17, 122, DIG. 11; 16/230 X, 252, 258 X, 267, 259, 260; 362/277, 362/297, 374, 310, 267, 147, 375, 396, 455, 362/225

See application file for complete search history.

(56) References Cited

U.S. PATENT DOCUMENTS

| | | | | | |
|---|---|---|---|---|---|
| 505,480 | A * | 9/1893 | Pletcher | 16/232 |
| 3,069,541 | A * | 12/1962 | Thomsen et al. | 362/343 |
| 3,328,579 | A * | 6/1967 | Lee | 362/322 |
| 3,370,164 | A * | 2/1968 | Lee | 362/322 |
| 3,748,465 | A * | 7/1973 | Murray et al. | 362/374 |
| 4,091,444 | A * | 5/1978 | Mori | 362/374 |
| 4,155,111 | A | 5/1979 | Kelly et al. | |
| 4,157,584 | A | 6/1979 | Bhatt | |
| 4,414,616 | A | 11/1983 | de Vos et al. | |
| 4,469,370 | A | 9/1984 | Petersen | |
| 4,689,729 | A * | 8/1987 | Ruud et al. | 362/375 |
| 4,910,650 | A * | 3/1990 | Goralnik | 362/147 |
| 5,172,976 | A | 12/1992 | Bogdanovs | |
| 6,000,550 | A * | 12/1999 | Simpson et al. | 206/711 |
| 6,105,809 | A * | 8/2000 | Yamanaka | 220/326 |
| 6,264,348 | B1 | 7/2001 | Ellis | |
| 6,578,233 | B1 | 6/2003 | Avila et al. | |

* cited by examiner

*Primary Examiner*—Patricia Engle
*Assistant Examiner*—Mark Williams
(74) *Attorney, Agent, or Firm*—Jansson Shupe & Munger Ltd.

(57) ABSTRACT

A hinging mechanism attaching an access panel to a housing is provided that has a latching device rigidly mounted to the inner surface of the panel and releasably pivotally secured to the interior surface of the housing, whereby the panel is detachable from the housing and free to move between open and closed positions. Preferably, the mechanism further includes a linkage member movably mounted to the interior surface, whereby the mechanism has articulation at independent points between the housing and the panel. The mechanism is also preferably one where the latching device includes a latch-bracket and a latch, the latch being pivotally attached to the latch-bracket.

17 Claims, 5 Drawing Sheets

DETACHABLE HINGING MECHANISM FOR ACCESS PANEL

FIELD OF THE INVENTION

This invention is related generally to hinging mechanisms and, more particularly, to hinging mechanisms of the type attaching an access panel to a housing with an access opening.

BACKGROUND OF THE INVENTION

Many electrical appliances and area lighting fixtures include housings that hold a number of the electrical components needed to operate the device. Such housings typically have a hinged access panel that give skilled personnel access to the equipment inside the housing for purposes of performing regular service and needed repairs on the apparatus. These housings have, however, a number of problems and shortcomings.

There are many occasions where access into certain housings is prevented by the presence of adjacent and abutting structures that obstruct and interfere in the full or even partial opening of the access panel. Physically detaching the panel from the housing is one solution but doing so may be quite strenuous since it will often involve removing fasteners and other hardware from the hinging mechanism to disassemble it from the housing. Moreover, removal of the panel can also be dangerous since the individual needing access to the housing may oftentimes perform this work from the top of a ladder.

If the housing is located outdoors and the hinging mechanism itself is mounted on the exterior of the housing, the hinging mechanism may also be exposed to the elements, leading to corrosion and other damage that will make opening and closing of the access panel difficult.

Quite apart from the harm created by the weather, access to the inside of many housings may often be difficult and time consuming because of their inconvenient location. Certain area lighting fixtures are, for instance, typically high in the air. The problems in working on such devices are compounded by the fact that, even with the access panel in its fully opened position, reaching into the housing to access all areas inside can still be awkward and frustrating.

This invention addresses these problems and shortcomings in a simple and inexpensive manner.

OBJECTS OF THE INVENTION

It is a primary object of this invention to provide an improved hinging mechanism that overcomes some of the problems and shortcomings of the prior art.

Another object of this invention is to provide a novel hinging mechanism that can easily detach and later reattach an access panel to a housing.

Another object of this invention is to provide an exceptional hinging mechanism that is detachable and articulable to facilitate access to all areas within the housing of an electrical device.

Still another object of this invention is to provide an excellent hinging mechanism that is detachable and compactly stores within the housing when the access panel is closed.

Yet another object of this invention is to provide a desirable hinging mechanism that is detachable and articulable and yet is simple to construct, not complicated to maintain, and highly reliable to use.

SUMMARY OF THE INVENTION

This invention is for a hinging mechanism to be used to attach an access panel to a housing in a detachable manner. The mechanism includes a latching device that is rigidly mounted to the inner surface of the access panel. The latching device is also releasably pivotally secured to the interior surface of the housing. The term "releasably pivotally secured" means a mode of attachment between two members where the first member is free to pivot, rotate or revolve about the second member when secured and the first member retains the ability to be manually disengaged from the second member without the need for tools or excessive force. The panel can therefore be easily detached from the housing and, when the panel is secured to the housing, the mechanism allows the panel to freely move between open and closed positions.

In certain preferred embodiments, the mechanism includes a linkage member that is mounted in a movable manner to the interior surface of the housing. This linkage member has a hinge-bar to which the latching device is releasably pivotally mounted. The linkage member gives the mechanism independent articulation at more than one point along its length between the housing and the panel.

More desirable is where the latching device has a latch-bracket and a latch. The latch is pivotally mounted to the latch-bracket such that detaching the latching device from the hinge-bar is accomplished with moving the latch from a secured position to a released position. Most preferred is where the latching device further includes a spring member engaged to the latch such that the latch is biased in an engaging, i.e., downward towards the access panel, direction.

A highly preferred embodiment finds the latch having rear and front appendages. The range of rotation in the latch about the latch-bracket is limited by the contact of either appendage with the latch-bracket. Also highly desired is where the latch-bracket includes two latch-supports positioned at its opposite ends. Each latch-support has a support-notch that is sized to receive the hinge-bar. The support-notches are also aligned with one another to allow the latch-bracket to receive the hinge-bar between both latch-supports. In certain preferred cases, the latching device includes a stabilizer bar that extends between the latch-supports and has the latch pivotally attached to it.

Most desired is where the latch has a grip-notch that allows it to trap the hinge-bar within the support-notches when in the secured (i.e., closed) position. More preferred is where the latch also has an inclined front surface positioned adjacent to the grip-notch. This surface is adapted to allow the latch to slidably engage the hinge-bar. When the latching device is then being attached to the linkage member, the latch is forced upward by the hinge-bar into the released (i.e., open) position in a manner that permits the latch and the support-notches to be able to receive and hold the hinge-bar.

In another embodiment that is desired, two support-mounts are rigidly secured to the interior surface of the housing and the linkage member has two substantially aligned linkage-arms. Each link-support has a proximal end that is pivotally mounted to a different support-mount. The hinge-bar extends between the distal ends of these linkage-arms.

Also highly desirable is where the length of the linkage-arms is less than the height of the latch-bracket such that the linkage-arms are able to nest within the latching device to enable the mechanism to be compactly stored within the housing whenever the access panel is closed. Highly preferred is where the hinging mechanism is used to attach the area lighting-fixture housing to its access door.

In another aspect of this invention, it is an improvement to an area lighting fixture of the type utilizing power-related components and a high-intensity-discharge lamp having a hinging mechanism for opening and closing the access door covering an opening to the fixture's housing. The improvement finds the hinging mechanism having a linkage member movably mounted to the interior surface of the housing and a latching device rigidly mounted to the inner surface of the door and pivotally secured in a releasable manner to a hinge-bar on the linkage member.

A preferred embodiment of this improved fixture is where the latching device includes a latch-bracket with two latch-supports, a latch pivotally mounted to the latch-bracket, and a spring member to bias the latch in the direction of its secured position. Each latch-support has a support-notch sized to receive the hinge-bar.

Most preferred finds the linkage member having two aligned linkage-arms that are pivotally mounted to support-mounts on the interior surface of the housing and that have the hinge-bar extending between their distal ends. More desirable is where the linkage-arms are shorter than the height of the latch-bracket to allow them to nest within the latching device when the access panel is closed.

In certain desired embodiments, the latch has a grip-notch and an inclined front surface adjacent to it. In these cases, the surface can slidably engage the hinge-bar such that the latch is thereby pivoted upward into its open position and the grip-notch is adapted to restrain the hinge-bar within the support-notches when the latch is closed. Highly desirable finds the latch having front and rear appendages that limit the latch's rotation upon the latch-bracket.

DETAILED DESCRIPTION OF PREFERRED EMBODIMENTS

Figure 1:
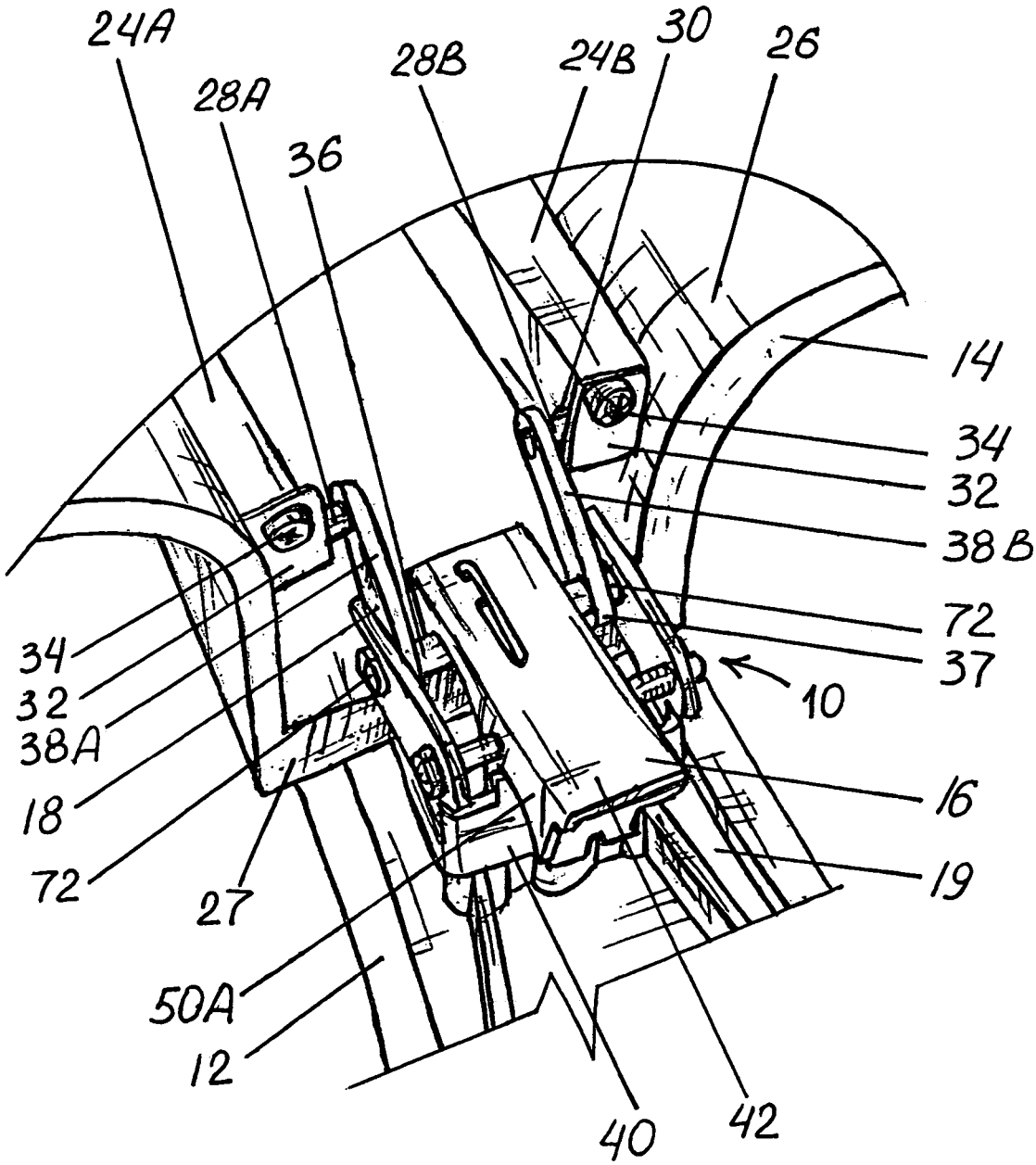
FIG. 1 is a perspective view of a preferred hinging mechanism in accordance with this invention.

The figures illustrate a preferred embodiment of an improved hinging mechanism for mounting an access panel to a housing in accordance with this invention. FIG. 1 is a perspective view of hinging mechanism 10 attaching access panel 12, often referred to as the access door, to housing 14 of an area lighting fixture 15. As shown, hinging mechanism 10 includes latching device 16 rigidly secured to inner surface 19 of access panel 12 and linkage member 18 pivotably mounted to housing 14.

Figure 4A:
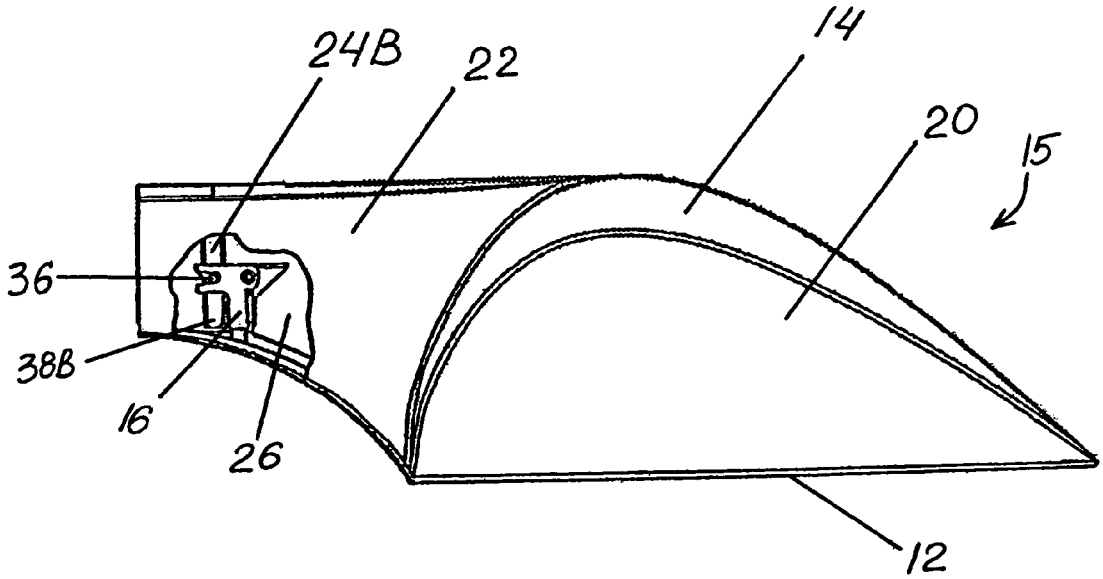
FIG. 4A is a partially cutaway side view of an area lighting fixture illustrating the positions and orientations of various features of the mechanism in FIG. 1 with the access panel in the closed position.

Housing 14 has lamp enclosure 20 forward of arm extension 22. Lamp enclosure 20 provides space for securing various components of lighting fixture 15 such as a high-intensity-discharge lamp and a variety of power-related components that include the ballast and capacitor (not shown). Housing 14 is provided with lateral wall 21, preferably formed from an aluminum casting. Lateral wall 21 defines opening 23 at the bottom of housing 14. Access panel 12 is sized to substantially cover opening 23 and enclose interior surface 26 of lateral wall 21 when access panel 12 is in its closed position (as illustrated in FIG. 4A). Access panel 12 provides access to the interior of housing 14 for such purposes as routine maintenance and also serves as a frame for holding a lens panel (not shown) for lighting fixture 15.

Two support-mounts 24A, 24B are formed by lateral wall 21 within arm extension 22, extending outward from interior surface 26. Support-mounts 24A, 24B are coplanar and equidistant from back edge 27 of arm extension 22. As illustrated in FIG. 1, pins 28A, 28B are collinear at opposite ends of linkage member 18. Pins 28A, 28B are received by channels 30 formed on the outer face (not shown) of each support-mount 24A, 24B. A plate 32 is secured, preferably by a screw 34, to the outer face on each support-mount 24A, 24B. Plate 32 retains pins 28A, 28B within channels 30. Channels 30 are sized to allow linkage member 18 to freely pivot upon pins 28A, 28B.

Linkage member 18, as seen in FIG. 1, is U-shaped with hinge-bar 36 positioned between distal ends 37 of two linkage-arms 38A, 38B extending orthogonally outward from pins 28A, 28B respectively. Hinge-bar 36 is coplanar with linkage-arms 38A, 38B and pins 28A, 28B. The distance between support-mounts 24A, 24B is greater than the length of hinge-bar 36 to permit linkage member 18 to pivot 360° about pins 28A, 28B unobstructed, including within the space between support-mounts 24A, 24B.

Figure 3:
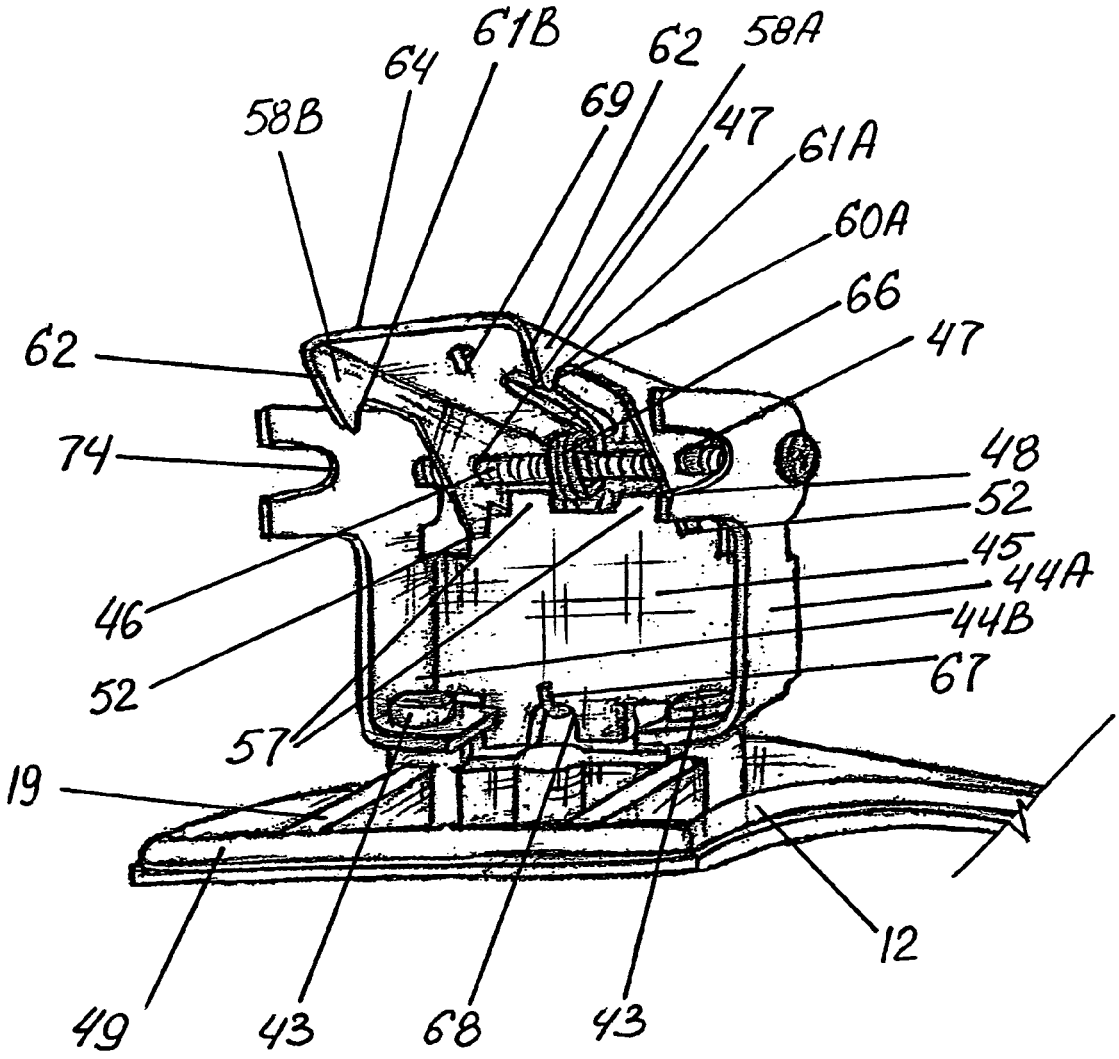
FIG. 3 is a front perspective view of the latching device in FIG. 2B.

Hinge-bar 36 is shown secured to latching device 16 in FIG. 1. Latching device 16 includes latch-bracket 40 and latch 42. Latch-bracket 40 has two substantially parallel latch-supports 44A, 44B at opposite ends of latch-panel 45. As seen in FIG. 3, latching device 16 is secured by fasteners 43 that are received by latch-supports 44A, 44B and threadably engage access panel 12.

Figure 2A:
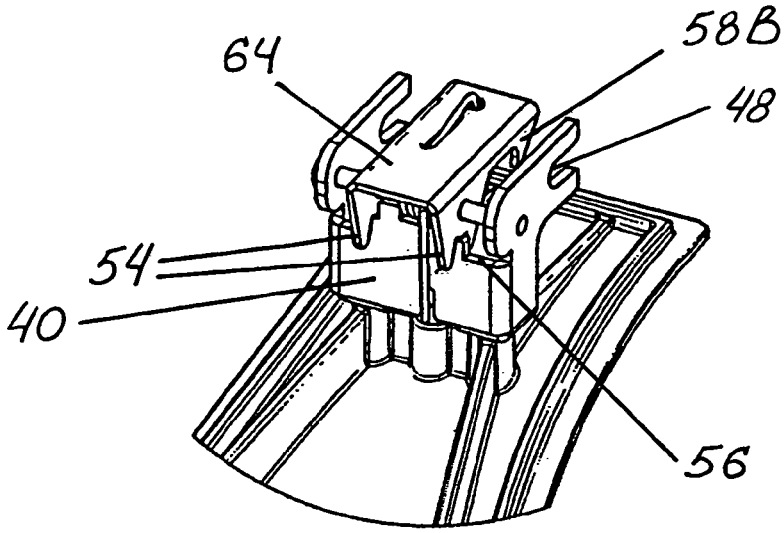
FIG. 2A is a rear perspective view of the latching device of the mechanism in FIG. 1 in the secured position.
Figure 2B:
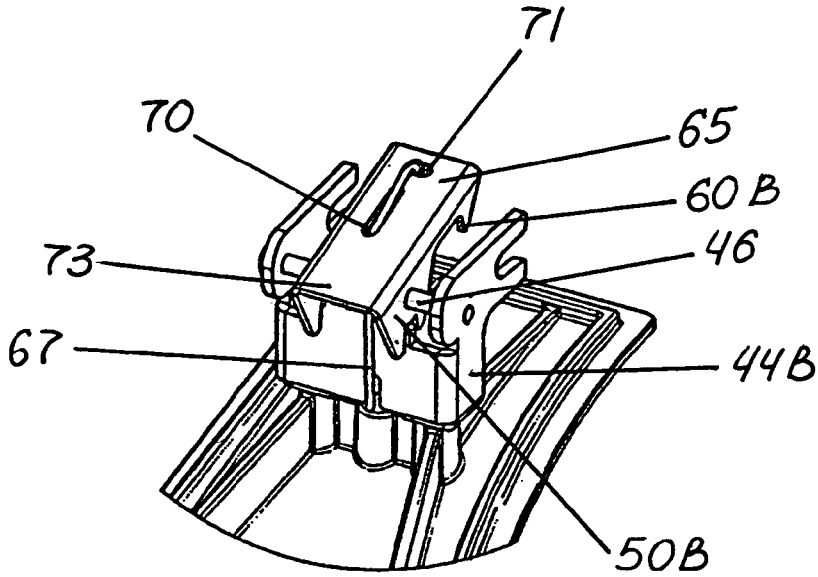
FIG. 2B is a rear perspective view of the latching device in FIG. 2A in the released position.

Stabilizer bar 46 is secured to and extends orthogonally between latch-supports 44A, 44B, preferably above and coplanar with latch-panel 45. Stabilizer bar 46, as illustrated in FIGS. 2A, 2B and 3, extends along a line parallel with rear edge 49 of access panel 12. Latch-supports 44A, 44B are provided with support-notches 48 located forward of stabilizer bar 46.

Stabilizer bar 46 passes through apertures 47 on side-panels 50A, 50B of latch 42. As illustrated in FIGS. 2A, 2B, and 3, side-panel 50A, 50B are substantially parallel to each other and to latch supports 44A, 44B. Each side-panel 50A, 50B has front appendage 52 and rear appendage 54. Latch 42 is positioned upon stabilizer bar 46 such that upper edge 56 of latch-panel 45 is received in the space between front appendage 52 and rear appendage 54 on each side-panel 50A, 50B. Latch 42 is free to pivot upon stabilizer bar 46 whereby forward rotation of latch 42 is limited by contact of first appendages 52 with latch-panel 45 and rear rotation of latch 42 is similarly halted upon contact of rear appendages 54 with latch-panel 45. As seen in FIG. 3, lateral movement of latch 42 is limited upon contact of either side-panel 50A, 50B with panel-tabs 57.

Side-panel 50A, 50B also include hook-portions 58A, 58B at the front of latch 42. Hook-portions 58A, 58B define grip-notches 60A, 60B within side-panels 50A, 50B. Grip-notches 60A, 60B are aligned such that apex 61A, 61B of each grip-notch 60A, 60B is coplanar with stabilizer bar 46. Hook-portions 58A, 58B form front surface 62. As illustrated in FIG. 3, front surface 62 is in a plane slanting downward towards inner surface 19 and at an acute angle to the plane of top surface 64.

Coil spring 66 is wound around stabilizer bar 46. First end 67 of spring 66 is extended around and secured to bottom edge 68 of latch-bracket 40. Second end 69 of spring 66 is extended through slot 70 towards top surface 64 before being placed through and hooked around top-aperture 71 or fastened to latch 42 in any similar suitable method. Spring 66 is biased to rotate front portion 65 of latch 42 downwards toward access panel 12 to keep latching device 16 in the secured position as shown in FIGS. 1 and 2A.

In operation, access panel 12 will typically be attached to housing 14 while housing 14 is overhead with opening 23 facing downwards toward the ground. After pivoting linkage member 18 so that hinge-bar 36 is hanging downward from housing 14, ends 72 of hinge-bar 36 are inserted into support-notches 48 of latching device 16. Continuing to move latching device 16 forward into hinge-bar 36 forces latch 42 upward through contact between hinge-bar 36 with front surface 62. Front surface 62 will always be in proper alignment for making direct contact with hinge-bar 36 due to the action of front appendages 52 that presents latch 42 in the desired position. Support-notches 48 sufficiently restrain movement of hinge-bar 36 so that contact between hinge-bar 36 and front surface 62 forces latch 42 upward rather than push hinge-bar 36 away. Upward movement of latch 42 continues until hinge-bar 36 can pass beneath hook-portions 58A, 58B so that hinge-bar 36 is received within grip-notches 60A, 60B and ends 72 are fully received within support-notches 48. After hinge-bar 36 has passed beneath hook-portions 58A, 58B, latch 42 immediately returns to its previous secured position to positively retain hinge-bar 36 within latching device 16 by snapping shut under the action of coil spring 66.

One can readily see that attaching access panel 12 to housing 14 in this manner does not require an individual to have a free hand to manually lift latch 42 but allows him to use both hands to lift access panel 12 into position. If necessary, latch 42 can also be easily pivoted into the released position (as shown in FIGS. 2B and 3) by pressing lightly with a single finger or thumb upon rear portion 73 of top surface 64. Rear appendages 54 serve as a stop to limit rotation of latch 42 to only that needed to reach the released position. Either approach leaves hinge-bar 36 firmly held in position within latching device 16 by nesting hinge-bar 36 between grip-notches 60A, 60B and proximal ends 74 of support-notches 48.

Figure 4B:
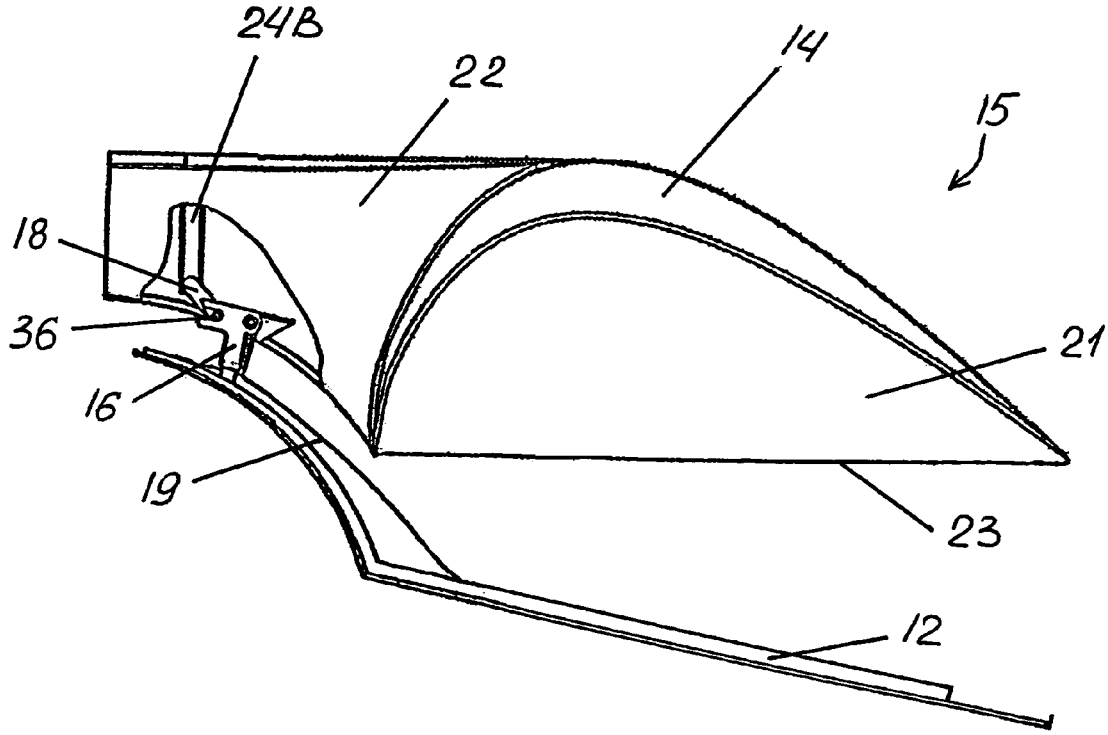
FIGS. 4B-4C are partially cutaway side views of the area lighting fixture in FIG. 4A illustrating the positions and orientations of various features of the mechanism in FIG. 1 with the access panel in different stages of the open position.
Figure 4C:
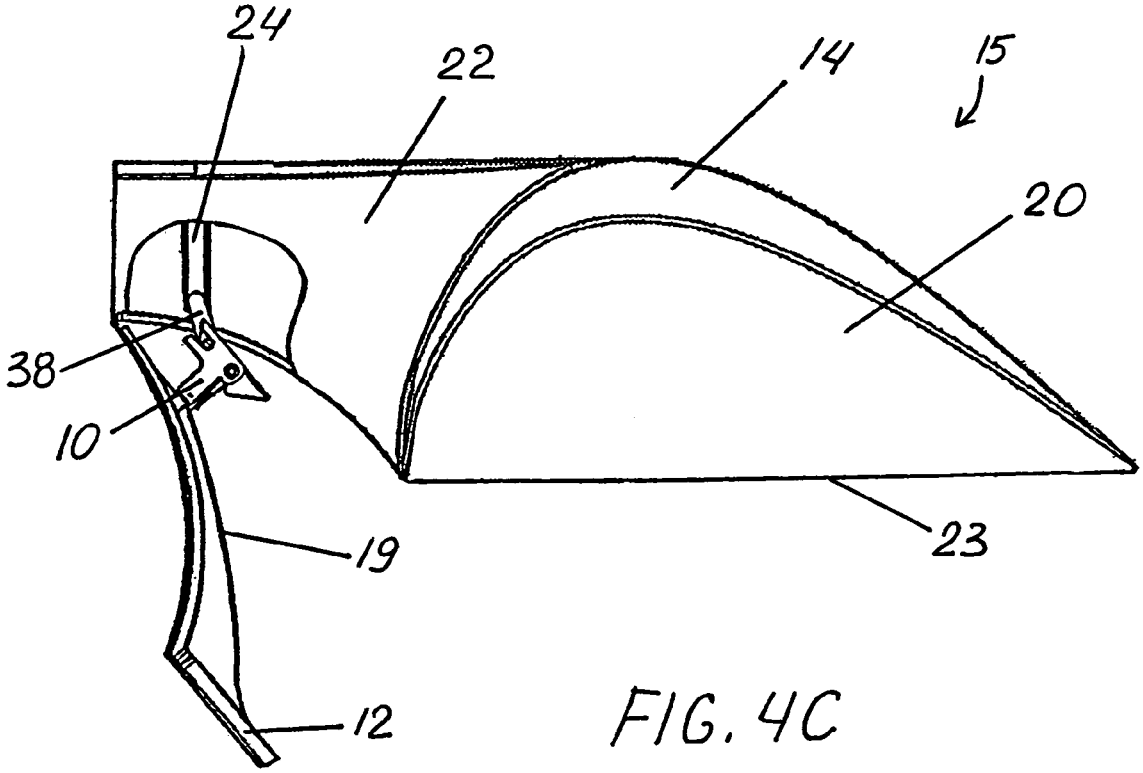
Figure 4D:
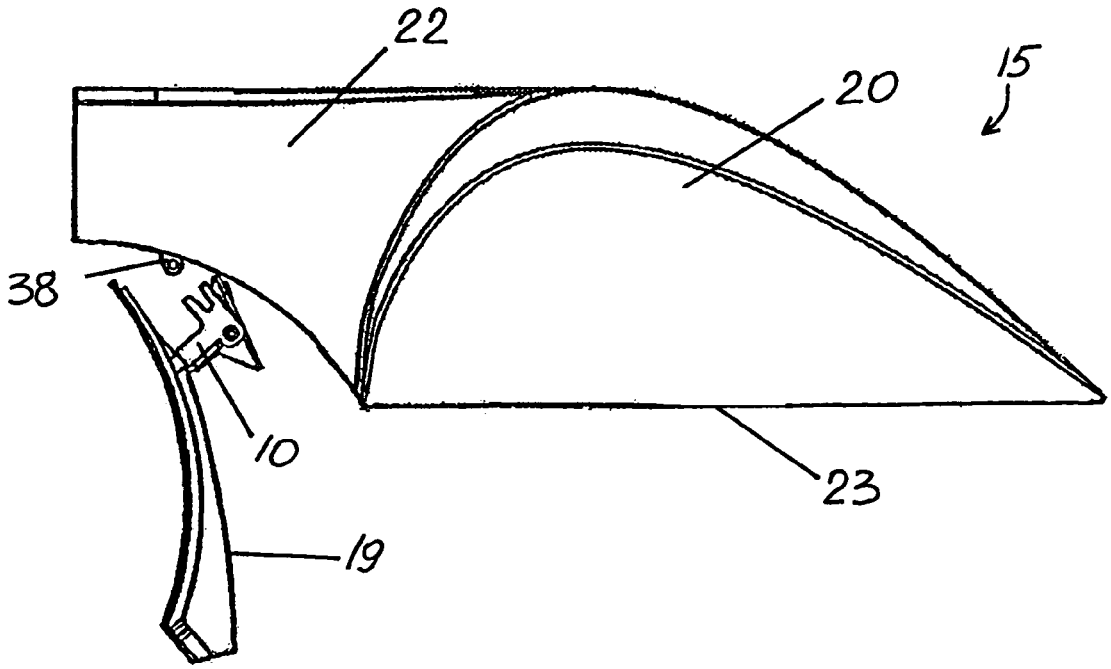
FIG. 4D is a side view of the area lighting fixture in FIG. 4A illustrating the detachment of the access panel from the area lighting fixture while in the open position.

In disengaging access panel 12 from housing 14 as illustrated in FIG. 4D, an individual need only place latch 42 in its released position by once again pushing down upon latch 42 at rear portion 73 with one finger. In this manner, hinge-bar 36 and thereby linkage member 18 can be quickly withdrawn from latching device 16 to fully detach access panel 12 from the rest of lighting fixture 15.

When access panel 12 is attached to housing 14, access panel 12 is able to move between a closed position (FIG. 4A) and a range of open positions (FIGS. 1, 4B, 4C) by utilizing hinging mechanism 10. In the closed position, linkage member 18 is pivoted upward into the interior of housing 14 to allow latching device 16 to rest between support-mounts 24A, 24B. Latching device 16 is sized so that the length of linkage-arms 38A, 38B is less than the height of latch-bracket 40 to permit linkage-arms 38A, 38B to nest beneath latch 42 so that latching device 16 can fit compactly within arm extension 22 when housing 14 is covered. Pins 28A, 28B have sufficient length such that latch-supports 44A, 44B are free to pass between support-mounts 24A, 24B and linkage-arms 38A, 38B as latching device 16 pivots about hinge-bar 36 into the closed position.

Access panel 12 is preferably kept in the closed position against the weight of access panel 12 drawing it open by the use of clasps (not shown) on access panel 12 that engage interior surface 26 of lamp enclosure 20. Releasing these clasps or otherwise pulling downward on access panel 12 lowers access panel 12 from housing 14 into the open position. FIGS. 4A, 4B illustrate how lowering access panel 12 from housing 14 is achieved by pivoting linkage member 18 about support-mounts 24A, 24B (only support-mount 24B being shown) so that hinge-bar 36 extends downward from opening 23. Additional extension of access panel 12 away from and to the rear of housing 14 is accomplished by pivoting latching device 16 about hinge-bar 36 as shown in FIG. 4C. In this manner, hinging mechanism 10 can be sized and positioned upon access panel 12 so as to permit access panel 12 to be rotated fully behind arm extension 22 of housing 14 as seen done in the fragmentary view of FIG. 1.

One can readily see how the present invention enables an access door to the housing for an apparatus such as an area lighting fixture to be easily and efficiently opened and closed. Moreover, when the access door is in the fully open position by being pivoted to the rear of the housing through the combined articulation of both the linkage member and the latching device of the hinging mechanism, complete and unobstructed access to all areas within the interior of the housing is achieved. In addition, complete removal or disengagement of the access door from the housing can be performed quickly and without the need for tools to disassemble the one from the other. The later re-attachment of the access door to the housing is equally simple to perform.

The various parts shown in the drawings and described above may be fabricated using a variety of materials and a variety of assembly procedures known to those skilled in the art. Moreover, it will be apparent to one skilled in the art that a hinging mechanism in accordance with this invention will preferably be made from stainless steel or similarly suitable materials selected to withstand the forces anticipated to be applied to it. The choice of material will therefore depend on the particular application being made of the hinging mechanism.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A hinging mechanism attaching an access panel to a housing, the housing having an interior surface and the access panel having an inner surface, the mechanism comprising a latching device rigidly mounted with respect to the inner surface, the latching device having a latch free to pivotally move between secured and released positions, and a linkage member pivotally mounted with respect to the interior surface and having a hinge-bar, the latching device receiving and entirely encompassing the hinge-bar in the secured position to releasably and pivotally secure the hinge-bar, whereby the panel is free to move between open and closed positions, the linkage member being free to pivot in the open position such that the mechanism is free to rotate concurrently about the interior surface and the hinge-bar, and the panel is detachable from the housing.

2. The mechanism of claim 1 wherein the latching device has a latch-bracket, the latch pivotally attached with respect to the latch-bracket, whereby the latching device is detachable from the hinge-bar with movement of the latch from the secured position to the released position.

3. The mechanism of claim 2 wherein the latching device further has a spring member engaged with respect to the latch, the spring member being adapted to bias the latch in the secured position.

4. The mechanism of claim 3 wherein the latch includes rear and front appendages, whereby rotation of the latch is halted upon contact of either appendage with the latch-bracket.

5. The mechanism of claim 3 wherein the latch-bracket includes two latch-supports at opposite ends, each latch-support having a support-notch sized to receive the hinge-bar, the support-notches being substantially aligned.

6. The mechanism of claim 5 wherein the latch-bracket further includes a stabilizer bar extending between the latch-supports and the latch is pivotally attached to the stabilizer bar.

7. The mechanism of claim 5 wherein the latch includes a grip-notch such that the grip-notch restrains the hinge-bar within the support-notches when the latch is in the secured position.

8. The mechanism of claim 7 wherein the latch further includes an inclined front surface adjacent to the grip-notch, the front surface being adapted to slidably engage the hinge-bar to allow the hinge-bar to pivot the latch into the released position, whereby the latching device is able to pivotally secure the hinge-bar.

9. The mechanism of claim 2 wherein two support-mounts are rigidly secured to the interior surface and the linkage member includes two substantially aligned linkage-arms, each of the linkage-arms being pivotally mounted to a separate support-mount and having a distal end, the hinge-bar extending between the distal ends.

10. The mechanism of claim 9 wherein the latch-bracket has a height and each of the linkage-arms has a length, the length being less than the height such that the linkage-arms can nest within the latching device to compactly store the mechanism within the housing when the access panel is in the closed position.

11. The mechanism of claim 1 wherein the housing is an area lighting-fixture housing and the panel is an access door.

12. In an area lighting fixture of the type utilizing power-related components and a high-intensity-discharge lamp and having a housing with an interior surface and an access opening, an access door with an inner surface and sized to cover the opening, and a hinging mechanism attaching the housing to the door for movement of the door between open and closed positions, an improvement wherein the hinging mechanism comprises:

a linkage member pivotally mounted with respect to the interior surface and having a hinge-bar, the linkage member being free to pivotally in the open position; and a latching device rigidly mounted with respect to the inner surface, the latching device having a latch free to pivotally move between secured and released positions, the hinge-bar being received by the latching device, the latching device entirely encompassing the hinge-bar in the secured position to releasably and pivotally secure the hinge-bar, whereby the door is detachable from the housing, and the mechanism is free to rotate concurrently about the interior surface and the hinge-bar to provide articulation at independent points between the housing and the door.

13. The lighting fixture of claim 12 wherein the latching device includes:

a latch-bracket having two latch-supports at opposite ends, each latch-support having a support-notch sized to receive the hinge-bar;

the latch pivotally attached with respect to the latch-bracket; and a spring member engaged with respect to the latch, the spring member being adapted to bias the latch in the secured position.

14. The lighting fixture of claim 13 wherein the interior surface has two support-mounts and the linkage member includes two substantially aligned linkage-arms, each of the linkage-arms being pivotally mounted to a separate support-mount and having a distal end, the hinge-bar extending between the distal ends.

15. The lighting fixture of claim 14 wherein the latch-bracket has a height and each of the linkage-arms has a length, the length being less than the height such that the linkage-arms can nest within the latching device to compactly store the mechanism within the housing when the door is in the closed position.

16. The lighting fixture of claim 15 wherein the latch has a grip-notch and an inclined front surface adjacent to the grip-notch, the front surface being adapted to slidably engage the hinge-bar to allow the hinge-bar to pivot the latch into a released position and the grip-notch being adapted to restrain the hinge-bar within the support-notches when the latch is in the secured position.

17. The lighting fixture of claim 16 wherein the latch further has rear and front appendages such that rotation of the latch is halted upon contact of either appendage with the latch-bracket.

* * * * *

UNITED STATES PATENT AND TRADEMARK OFFICE

CERTIFICATE OF CORRECTION

PATENT NO. : 7,419,196 B2
APPLICATION NO. : 11/089928
DATED : September 2, 2008
INVENTOR(S) : Eric J. Haugaard et al.

It is certified that error appears in the above-identified patent and that said Letters Patent is hereby corrected as shown below:

Column 8, line 3, after “to”, delete “pivotally” and insert --pivot--.

Signed and Sealed this

Twenty-third Day of December, 2008

JON W. DUDAS
*Director of the United States Patent and Trademark Office*